US005546681A

United States Patent [19]

Goldston et al.

[11] Patent Number: 5,546,681

[45] **Date of Patent: *Aug. 20, 1996**

[54] FOOTWEAR WITH FLASHING LIGHTS

[75] Inventors: Mark R. Goldston; Jon L. Bemis, both of Santa Monica; William J. Robinson, Manhattan Beach, all of Calif.

[73] Assignee: L.A. Gear, Inc., Santa Monica, Calif.

[ * ] Notice: The term of this patent shall not extend beyond the expiration date of Pat. No. 5,303,485.

[21] Appl. No.: 164,902

[22] Filed: Dec. 10, 1993

Related U.S. Application Data

[63] Continuation-in-part of Ser. No. 13,839, Feb. 5, 1993, Pat. No. 5,303,485.

[51] Int. Cl.[6] ..... A43B 23/00; A43B 7/04

[52] U.S. Cl. ..... 36/137; 362/103; 362/802

[58] Field of Search ..... 36/137, 139, 132, 36/136; 362/103, 802, 267

[56] References Cited

U.S. PATENT DOCUMENTS

| | | | |
|---|---|---|---|
| 2,572,760 | 10/1951 | Rikelman | 36/137 X |
| 4,412,205 | 10/1983 | Von Kemenczky | 36/137 X |
| 4,848,009 | 7/1989 | Rodgers | 36/137 |
| 5,019,950 | 5/1991 | Johnson | 362/802 |
| 5,285,586 | 2/1994 | Goldston et al. | 36/137 |
| 5,303,485 | 4/1994 | Goldston et al. | 36/137 |

FOREIGN PATENT DOCUMENTS

| | | | |
|---|---|---|---|
| 0121026 | 10/1984 | European Pat. Off. | 36/137 |
| 2227714 | 12/1974 | France | 36/137 |
| 2675025 | 10/1992 | France | 36/137 |
| 0489219 | 8/1954 | Italy | 36/137 |

*Primary Examiner*—Ted Kavanaugh
*Attorney, Agent, or Firm*—Don C. Lawrence

[57] ABSTRACT

Footwear for improving the visibility of the wearer includes a processing circuit that responds to operation of switch to turn a lighting system disposed in the footwear off and on. The switch is responsive to pressure from the foot of the wearer. When a wearer raises a foot from the ground, the lighting system is activated. When the foot is returned to the ground, or at the expiration of a predetermined period of time, the lighting system is deactivated.

13 Claims, 4 Drawing Sheets

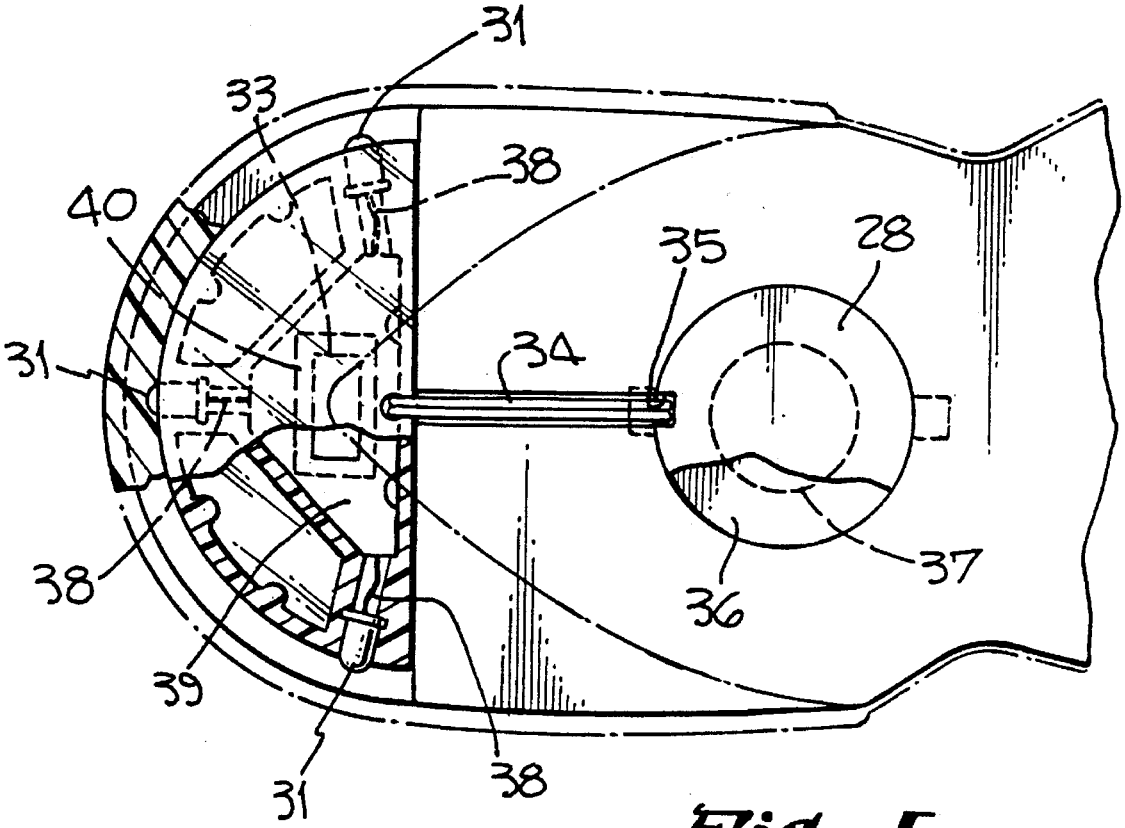
Fig. 5.
Fig. 4.
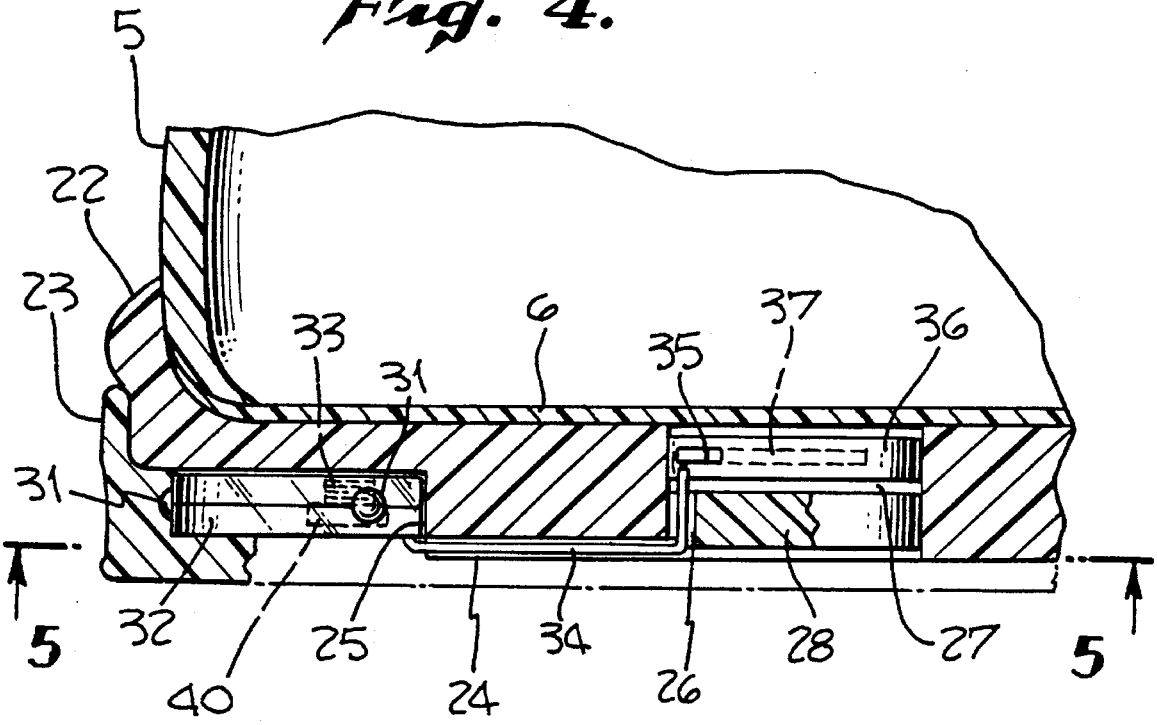

FOOTWEAR WITH FLASHING LIGHTS

RELATED APPLICATIONS

This application is a continuation-in-part of allowed U.S. patent application Ser. No. 08/013,839, filed Feb. 5, 1993, now U.S. Pat. No. 5,303,485 which application is incorporated herein by reference in its entirety.

FIELD OF THE INVENTION

This invention pertains to footwear in general, and in particular, to footwear with lights that flash to enhance the visibility of the wearer.

BACKGROUND OF THE INVENTION

Footwear having lighting devices incorporated therein are known. Lighting devices have been incorporated into a variety of footwear including dress shoes, athletic shoes, boots, sandals, etc. Reasons for including lighting devices in footwear include permitting the wearer to see or be seen in reduced light situations, to provide special effects during entertainment events, or as an element of fashion on the part of the wearer.

There are several implementations of footwear incorporating lighting devices. A first simple implementation includes a light source, (e.g. an incandescent bulb, a neon tube, or a light emitting diode ("LED"), a portable power supply such as a battery and a manually operated on-off switch. These elements are connected as an electric circuit and are located in a convenient location in the footwear, such as within the sole and/or heel structure.

A more complex implementation of lighted footwear includes the provision of a switching circuit to switch the light on and off in association with the presence or the absence of the wearer's foot in the shoe or the contact of the wearer's foot with the ground. The above-incorporated patent application is an example of this second implementation.

A third implementation involves the use of a motion switch which is utilized the detect movement of the wearer's foot. The detection of movement causes the light to illuminate. Such a motion switch could involve the use of a "tilt switch," i.e., a mercury switch, to sense the angular position of the shoe with respect to the ground gradient to activate the circuit at a particular attitude.

Shoes incorporating the above-discussed features to increase the visibility of the wearer often have several shortcomings. Shoes which provide for continuous illumination of the lighting device tend to exhaust batteries more quickly than those that are on only intermittently. Shoes which utilize lighting devices that illuminate only when the foot is in contact with the ground or at a certain angular position relative to the ground (i.e. movement detection type devices) are not effective in providing for increased visibility of the wearer for several reasons. In addition, the lighting systems themselves oftentimes do not operate in a reliable manner.

Further, such shoes are typically expensive to manufacture and produce due to the added cost of the lighting system incorporated therein. Finally, such shoes are typically unsuitable for serious athletic activities. This is due to the reduced structural integrity of the shoe caused by the incorporation of the lighting device, as well as an unacceptable increase in the weight of the shoe.

When footwear is provided with a lighting system that lights when the foot contacts the ground, the light is likely to be obscured by material on the ground when the foot is at ground level. For example, if a shoe is designed to illuminate when the wearer's foot contacts the ground, if the wearer is travelling through moderately high grassy conditions, the light will not be visible due to it being obscured by the grass. The higher the light is above the ground when it illuminates, the further away it can be seen. In addition, if the footwear emits visible light only when the shoe contacts the ground, the illumination typically occurs when the lighting device is in an essentially static condition, i.e., it is not moving when the footwear is on the ground. It is known that moving lights are more readily visible to bystanders.

There are two psychophysical phenomena which act to insure that moving lights will be more readily seen than static ones: First, in a static field, a moving object is more easily detected by the eye than a static one. Second, under appropriate lighting conditions, a moving point source of light is perceived, due to the phenomenon of "persistence," by the human eye (and some cameras) as a large, elongated streak of light "painted" on the retina of the eye by the point source, rather than as a small, moving point of light.

Thus, there is a need for a shoe which incorporates an economical and reliable lighting system that illuminates when the wearer's foot is removed from the ground, and which ceases the illumination when the wearer's foot regains contact with the ground. Such footwear would be more readily visible to third parties and would provide the wearer of the shoe with greater visibility when participating in walking, running and other athletic activities. Such a shoe needs to be capable of being manufactured in a cost-efficient and simplified manner, but must be suitable for use in conducting typical athletic activities by not sacrificing performance and weight factors to accommodate the lighting system.

SUMMARY OF THE INVENTION

The novel footwear of the present invention overcomes the problems of the prior art described above and enhances the visibility of the wearer through the provision of a simple, economical and reliable lighting system that illuminates when the wearer's foot is removed from contact with the ground and which ceases the illumination when the wearer's foot is returned to contact with the ground. The lighting system of the present invention conserves battery life by only providing illumination in an intermittent fashion and does not detract from the performance of the shoe.

The present invention provides for a circuit powered by a battery which responds to operations of a switch preferably disposed in a midsole area of the shoe. Depending upon the purpose for which the shoe is being manufactured, the circuit can be provided with a timer which can be altered to adjust the duration of light illumination after the wearer's foot is removed from the ground. In this fashion, the light can be programmed to illuminate from the time the wearer removes a foot from the ground until the wearer places the foot back on the ground. Alternatively, the timer can be adjusted such that the light illuminates for a desired, predetermined period of time after the wearer removes a foot from the ground, and is then extinguished. Thus, for example, when the wearer crosses a leg, the light in the shoe which does not contact the ground will only light for the predetermined time. In this fashion, battery life can be extended while maintaining the advantage of high visibility of the wearer during normal walking and running activities.

The above-discussed embodiment of the present invention is simple, reliable, and cost effective from a manufacturing standpoint. Since the preferred embodiment incorporates electronic components, circuits can be sized so as to be capable of being incorporated into virtually any part of the shoe. The use of such components also results in a light weight device which is sufficiently small so as to avoid detracting from the performance of the shoe.

Further, it is possible to select low-power consuming components, thereby extending the life of the battery necessary to power the circuit. Finally, each of these devices can be provided with mechanisms which enable the lighting devices to be deactivated such that they will not illuminate in response to the wearer either placing a foot on the ground or removing it therefrom.

The above and other features and advantages of the present invention will become more readily apparent upon a reading of the detailed description of the present invention taken in conjunction with the drawings of which the following is a brief description. While the drawings do illustrate the current preferred embodiment of the present invention, it should be clear that the invention is in no way limited to the embodiment shown in the drawings. The present invention is solely limited by the claims which are appended to this specification.

BRIEF DESCRIPTION OF THE DRAWINGS

FIG. 4 is a side cutaway view of the footwear of FIG. 1 taken along lines 4—4;

FIG. 5 is a partial bottom sectional plan view taken along the lines 5—5 of FIG. 4.

DESCRIPTION OF THE PREFERRED EMBODIMENT

Figure 1:
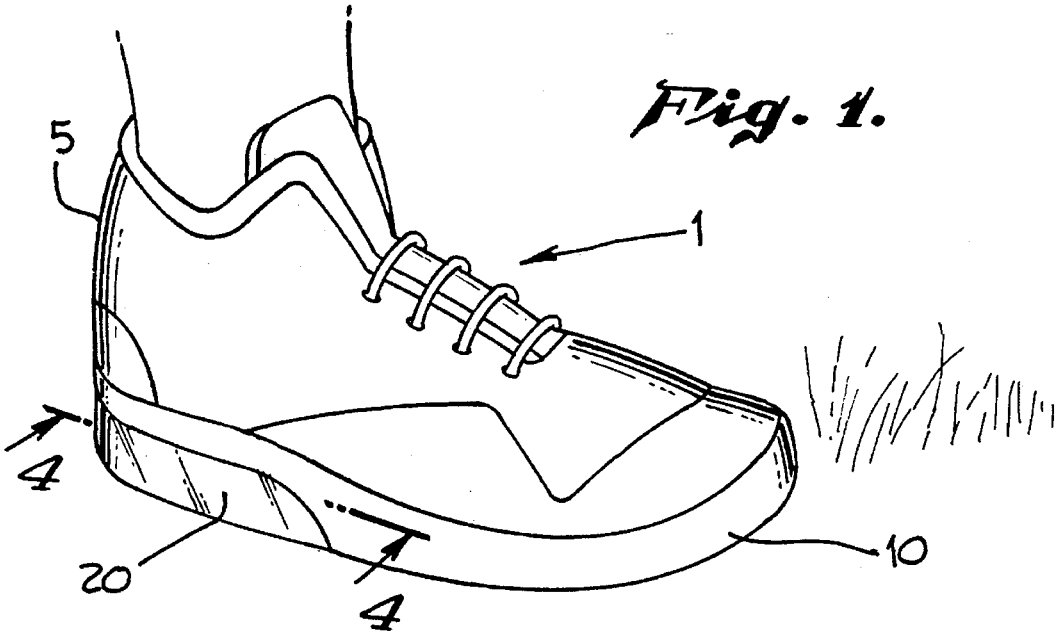
FIG. 1 is a side perspective view of footwear which incorporates the novel lighting system of the present invention.

The following discussion of the preferred embodiment of the present invention focuses on athletic shoes, and in particular incorporation of the novel lighting system in an athletic shoe. It should be understood that the present invention is not limited to use with athletic shoes but is suitable for use for all types of footwear, including, but not limited to work shoes, children shoes, dress shoes, walking shoes, and specialty footwear.

Referring to FIGS. 1–5, an athletic shoe 1 typically includes an upper 5 and a sole portion 10. An insole 6 typically resides in upper 5 above the sole portion 10. A transparent, window-like structure 20 is provided about a heel of the sole portion 10. The transparent structure 20 may be molded integral with the sole portion 10 or may be bonded thereto with a suitable adhesive. When the wearer raises the shoe from contact with the ground, visible light 21 is emitted from the transparent structure The sole portion 10 of the shoe 1 includes a midsole 22 and an outer sole 23 which is fixedly attached along the base of the shoe 1. The outer sole is typically formed from a solid, wear-resistant material such as rubber and certain polyurethane materials, whereas the midsole is typically formed in an injection or thermoformive process from a foamed, resilient material such as polyurethane (PU) or ethylene vinyl acetate (EVA). The use of the solid material for the outer sole provides for greater durability as the typical midsole material tends to wear relatively poorly when exposed to contact with ground surfaces.

A light producing mechanism 30 is disposed in the midsole portion 10 of the shoe 1, preferably below the heel of the wearer's foot. The light producing mechanism 30 incorporates a plurality of light-emitting diodes 31 (LEDs) which are provided about the circumference of a housing 32. The housing 32, which may be made from plastic or other suitable, resilient yet solid material in an injection molding process, contains a lighting control circuit 33. Preferably, housing 32 is positioned within the midsole 22, or immediately adjacent thereto, so that LEDs 31 are positioned next to the transparent structure 20, thereby enabling light emitted by the LEDs 31 to be visible exteriorly of the shoe 1.

The lighting control circuit 33 is preferably disposed on a printed wire board (PWB) 39 to which the LEDs 31 are connected via conductors 38. PWB 39 is shown in the FIGURES as being positioned within housing 32 but may also be disposed in the battery casing 36. A switch 40 is disposed beneath the lighting control circuit 33. The switch 40 is preferably a normally open, pressure sensitive membrane switch that closes in response to pressure from the foot of the wearer. Since housing 32 is resilient, switch 40 is able to operate while being encased therein. In this fashion, when the wearer raises a foot, the switch 40 opens. Alternatively, the switch 40 can be a pressure sensitive microswitch, or other suitable switching device.

Electrical conductors 34 connect the lighting control circuit 33 with a pair of battery terminals 35. A battery casing 36 is provided separate from the housing 32 and encases a battery 37 therein. The battery casing 36 can be positioned at any desired location within the midsole 22 of the shoe 1, but is preferably disposed in the arch portion of the midsole 22. When the PWB 39 is provided in the battery casing 36, positioning the casing 36 in the arch portion of the midsole, which is subject to less pressure and stress than the heel portion of the midsole 22, provides additional protection for the lighting control circuit 33.

A lateral wire channel 24 and vertical wire channel 26 are formed in the midsole 22 to provide a path for the electrical conductors 34 from the lighting control circuit 33 to the battery terminals 35. A cavity 25 is formed in the midsole 22 to receive the housing 32 therein. A battery cavity 27 is provided to accommodate the battery casing 36. A battery support 28, which may be made of the same material as the midsole 22 or from a different material, is disposed in the battery cavity 27 below the battery casing 36. The battery cavity 27 is shown in the drawings in the preferred position below the arch of the wearer's foot.

The above-discussed structure may incorporate the preferred embodiment of the present invention. However, it should be understood that the structure of a finished shoe which incorporates the present invention may differ from those items shown in the drawings.

For example, the battery casing 36 is shown disposed in the battery cavity 27 in spaced relation to a separate battery support 28. In practice, the battery support 28 may abut the under surface of the battery casing 36. The battery support 28 could be a separate element as shown, or could be molded as part of the outer sole 23, depending upon the desired hardness thereof. In addition, the insole 6 could directly overlay the battery casing 36 to provide a flush fit therewith.

Further, channels 24 and 26, along with cavities 25 and 27, could be molded therein or could be die cut from the midsole material 22 after the midsole is formed. While FIG. 4 illustrates housing 32 being positioned between the outer sole 23 and the midsole 22, outer sole 23 or midsole 22 could be formed to completely encapsulate the housing 32 while allowing LEDs 31 to protrude therefrom.

In the exemplary embodiment shown in FIG. 5, the midsole 22 incorporates a so-called "cup sole" type of construction, in which the midsole 22 is formed to as an upwardly-facing cup in to which the upper portion 5 is received during attachment of the two portions. The side walls of the midsole cup may be extended upwardly to lap and adhere to the upper portion 5 for added lateral support of the foot and to provide enhanced adhesion with the upper 5.

In operation, in accordance with the preferred embodiment, the present invention is designed to provide illumination which is visible to bystanders when the wearer of the footwear lifts a foot from a ground surface. Thus, when the wearer stands in a single position, the footwear does not give off illumination. When the wearer walks, runs, or otherwise raises a foot from the ground, the footwear is designed to illuminate from substantially the time when the wearer's foot loses contact with the ground until the wearer's foot again contacts the ground. Alternatively, the present invention provides a system for timing the illumination such that the footwear is illuminated for a predetermined period of time after the individual's foot leaves the ground.

Figure 3:
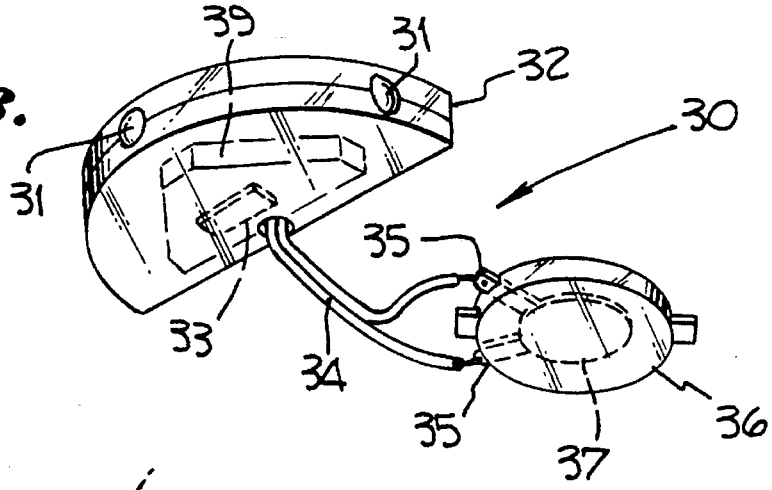
FIG. 3 illustrates a preferred embodiment of the lighting system of the present invention.
Figure 2:
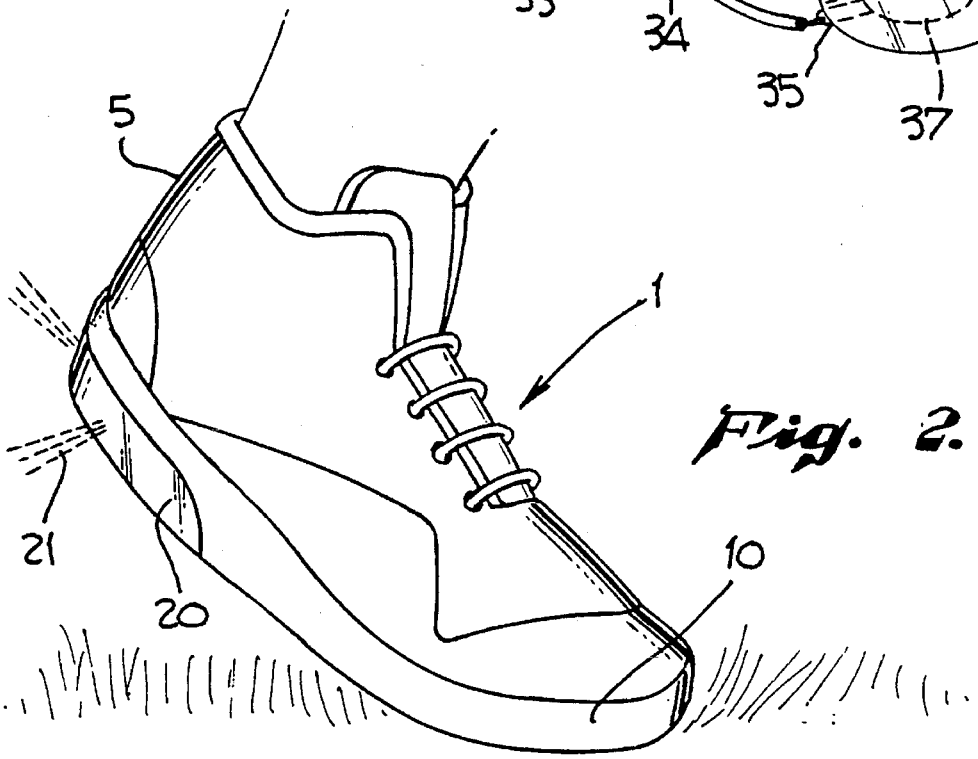
FIG. 2 is a side perspective view of the footwear of FIG. 1 showing the illumination of the lighting system of the present invention.
Figure 6:
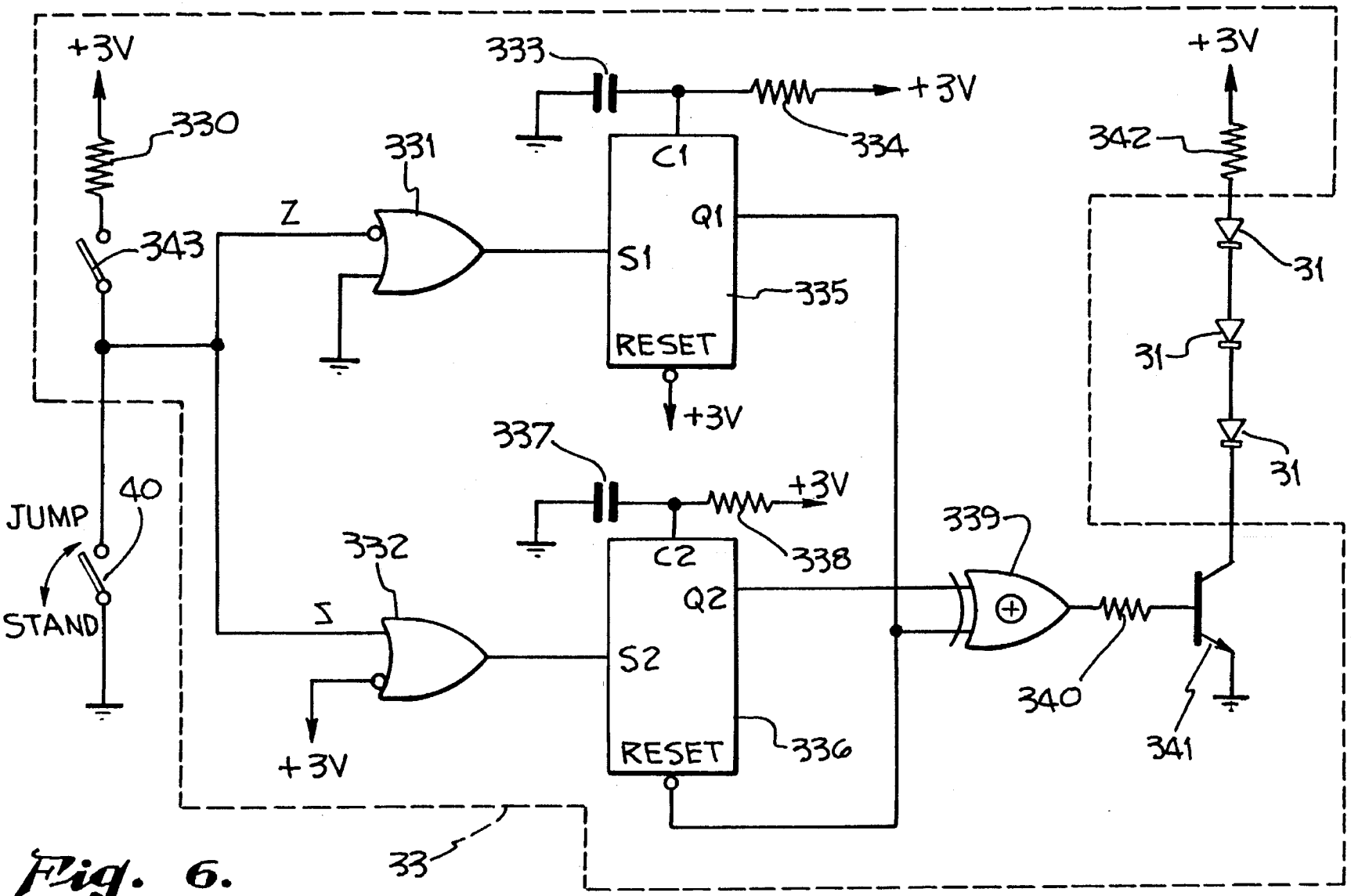
FIG. 6 is a schematic diagram of a preferred embodiment of the lighting control circuit shown in FIG. 3.

The illumination of the LEDs 31 is controlled by the lighting control circuit 33 shown in FIG. 3. Turning to FIG. 6, the preferred embodiment of the lighting control circuit 33 is shown schematically. FIG. 6 uses the convention "+3 v" to indicate a particular element is tied to a three volt power supply which would generally be provided by a dry cell, "button-type" lithium battery, which provides extremely long life coupled with a lightweight structure. It should be clear that other forms and voltages of batteries could be utilized with the present invention. In addition, the embodiment of FIG. 6 uses a normally closed pressure switch as the switch 40. A normally closed pressure switch is a switch which opens in response to the application of pressure thereto, and which closes when the pressure is removed therefrom.

As can be seen in the diagram, a 50,000 ohm ("50 kΩ") pull-up resistor 330 is connected at one end thereof to the +3 v power supply and is connected with an optional on-off switch 343 at the other end thereof. On-off switch 343 would only be provided if it were desired to allow the wearer of the athletic shoe 1 to selectively enable or disable the lighting system of the present invention, but its provision is not essential for present operations, for reasons which will become clear in the following discussion. Switch 343 is preferably mounted on an exterior side surface of midsole 22 to be easily accessible to a wearer of the shoe 1.

Switch 343 is coupled to the switch 40 and to an input of OR gates 331 and 332. Each OR gate 331 and 332 has one inverted input. The inverted input of OR gate 331 is tied to switch 343 while the second input thereof is tied to "ground." It should be understood that "ground" in the electrical sense here means the negative input of the battery 37 and not the ground upon which a wearer walks. The inverted input of the OR gate 332 is tied to the +3 volt power supply, while the non-inverted input thereof is tied to the switch 343. The outputs of the OR gates 331 and 332 are supplied to monostable multivibrators 335 and 336 (also known as "one-shots"). The multivibrators include signal inputs S1 and S2, reset inputs, clock inputs C1 and C2, and outputs Q1 and Q2, respectively.

Although shown as separate elements for illustration purposes, the OR gates 331 and 332 and monostable multivibrators 335 and 336 are preferably implemented in a single package using Motorola's 14528 Dual Monostable Multivibrator integrated circuit chip. On the 14528 chip, OR gates 331 and 332 are essentially formed in an integral fashion with the multivibrators 335 and 336, and serve as the inputs to the multivibrators. By using inverting inputs with OR gates 331 and 332 in the manner shown in the drawings, multivibrators 335, 336 are configured so as to trigger on opposite transitions of the switch 40.

Tied to the clock input C1 of multivibrator 335 is a 47 microfarad ("μf") capacitor 333 and a 2,000,000 ohm ("MΩ") resistor 334 which is tied to the +3 v power supply. A similar arrangement of a 47 μf capacitor 337 and a 2MΩ resistor 338 are connected to the clock input C2 of the other monostable multivibrator 336. The resistor/capacitor combinations each form a RC time constant which is used to control the duration of the output pulses of the monostable multivibrators 335 and 336. This will be explained in more detail below.

The output Q1 of multivibrator 335 is tied to one input of an exclusive OR (XOR) gate 339 and to the reset input of multivibrator 336. The inverted reset input of the monostable multivibrator 335 is tied to the +3 volt supply, and in this fashion multivibrator 335 is always enabled. The output Q2 of multivibrator 336 is supplied to the other input of the XOR gate 339. The output of XOR 339 is supplied to an NPN transistor 341 through a base current limiting resistor 340 which is preferably 10 kΩ. The emitter of the NPN transistor 341 is tied to ground and the collector is connected with the light emitting diodes 31. The light emitting diodes are also connected to a current limiting resistor 342 which is tied to the +3 volt power supply.

More specifically, multivibrator 335 is configured so as to trigger on a "negative" transition of the voltage at the switch 40 which occurs when the switch is closed. Switch 40 in this embodiment is biased so as to be normally open when a individual is standing on the switch and applying pressure thereto. This results in the inverted input to OR gate 331 being tied to the +3 v supply which, when inverted, results in a "0" being applied to one input of the gate 331. Since the other input of gate 331 is tied to ground, there are two "0" inputs being applied and the output is therefore "0".

When pressure is removed from switch 40 (e.g., when an individual raises a foot from the ground), switch 40 closes, causing the inverted input of OR gate 331 be tied to ground through switch 40. The inverted input of gate 331 causes this to actually appear as a logical "1" and therefore gate 331 is being supplied with a "0" on one input and a "1" on the other. This results in the output of gate 331 becoming "1". This causes multivibrator 335 to generate a pulse at the Q1 output.

It should be noted that, depending upon the quality of switch 40 or the sensitivity of the components used for the circuit 33, it may be necessary to provide a debouncing circuit to debounce the switch 40. Since a switch operation can actually comprise a large number of connections and disconnections before an equilibrium state is reached, a debouncing circuit monitors the operation of the switch to ensure that a circuit does not respond to a switch operation until the switch is in a definite closed or open position. The provision of such a circuit, which is common in electronic circuits, is well within the purview of the skilled artisan and further discussion thereof is omitted.

The duration of the Q1 output pulse is determined by the RC constant formed on the basis of capacitor 333 and resistor 334. With a 47 μf capacitor and a 2MΩ resistor, the time constant is approximately two seconds. By altering the values of capacitor 333 and resistor 334, the two second time duration can easily be pre-adjusted to any desired length.

The Q1 output is supplied to XOR 339 which has a "1" output when only one of its inputs is a high value. The XOR 339 is used to drive a transistor 341, which must be supplied with a voltage at its base in order to be turned "ON" to supply current to LEDs 31 to enable them to light.

Figure 7:
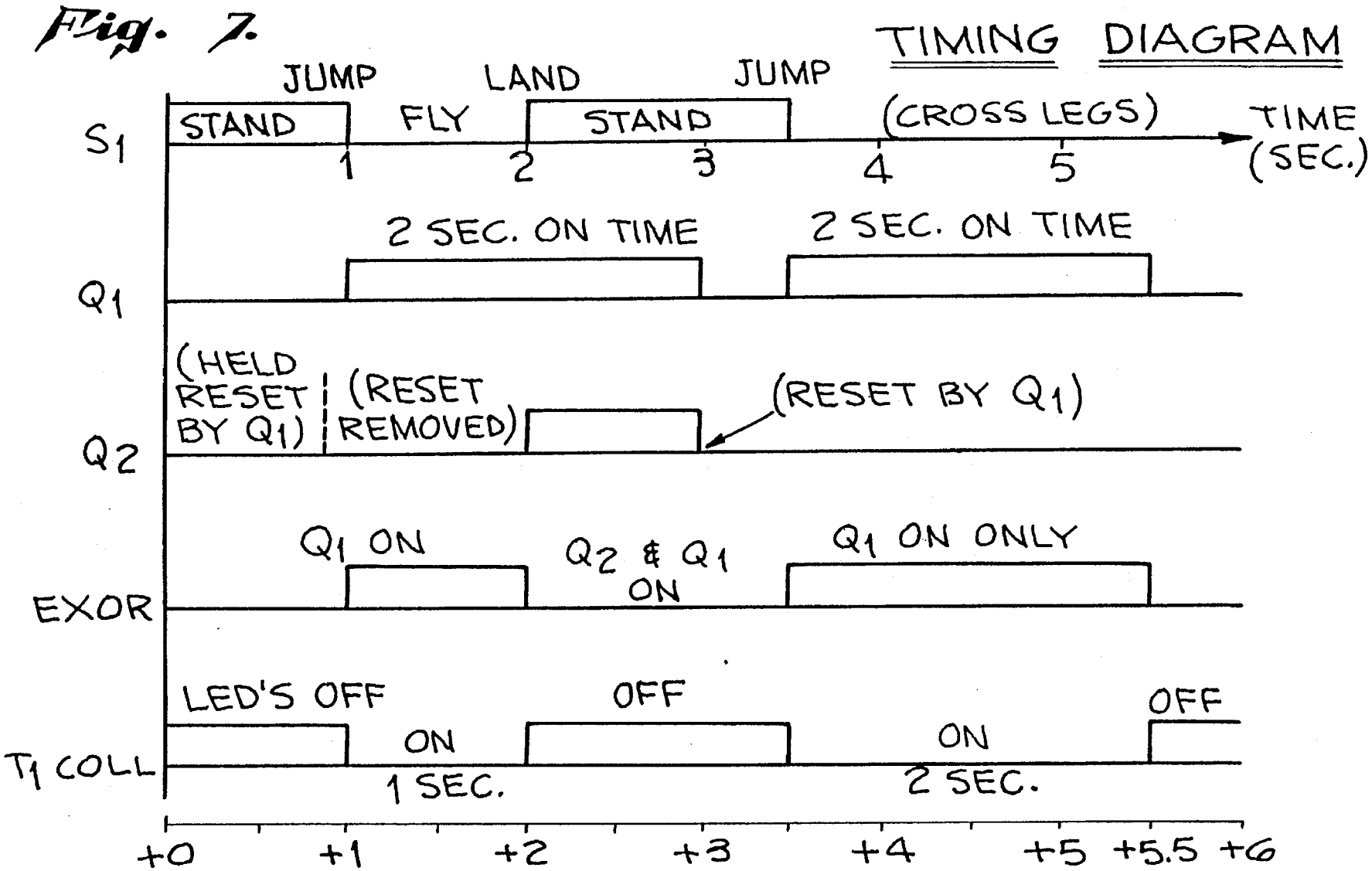
FIG. 7 is a timing diagram associated with the lighting control circuit of FIG. 6.

As can be seen in the timing diagram shown in FIG. 7, at time t0 switch 40 (i.e., $S_1$) is open, the voltage at the switch is high (i.e., logical "1"), and the outputs Q1 and Q2 are at a low value (i.e., logical "0"). This causes the output of XOR 339 to be low, which in turn causes transistor 341 to be essentially an open circuit which does not conduct current. This results in a high voltage being present at the collector of transistor 341 (i.e., $T_1$coll) and LEDs 31 are in the OFF state due to the inability of transistor 341 to conduct.

At time t1, pressure is removed from the switch 40, causing $S_1$ to close and the voltage at the switch to go to ground. Output Q1 thus goes from a low to a high state, which, in turn, causes the reset input of multivibrator 336 to transition from high to low, i.e. the reset is removed from the multivibrator 336. At the same time, XOR 339 is provided with one high input (output Q1) and one low input (output Q2) causing the output of XOR 339 to transition from low to high. This causes transistor 341 to begin conducting, which causes LEDs 31 to illuminate.

At time t2, switch 40 opens, e.g., when a landing occurs. This action does not affect output Q1, the state of which is determined by the RC time constant formed by capacitor 333 and resistor 334. However, opening switch 40 results in a high input being provided to OR gate 332 (i.e., opening switch 40 causes the non-inverted input of gate 332 to be tied to the +3 v supply through resistor 330). This causes the output of gate 332 to change from low to high which triggers multivibrator 336, thus causing Q2 to transition from low to high. When this occurs, XOR 339 is provided with two high inputs, and the output thereof changes from high to low. When the output of XOR 339 goes low, transistor 341 stops conducting and LEDs 31 shut off.

At time t3, although there is no change in the state of the switch 40, the output Q1 of multivibrator 335 changes from high to low due to the expiration of the time period determined by the RC time constant. When Q1 transitions from high to low, multivibrator 336 is reset since Q1 is tied to the inverted reset input of the multivibrator 336. This causes Q2 to change from high to low. At this point, the circuit is reset and will respond to another operation of the switch 40.

At time 3.5 (approximately), as shown in FIG. 7, if an individual crosses a leg or otherwise removes pressure from switch 40 for an extended period of time, switch 40 closes, Q1 transitions from low to high, and the output of XOR 339 goes high since Q2 is low. This results in LEDs 31 lighting. If the wearer does not return the foot to the ground or otherwise apply pressure to open switch 40, Q2 does not transition from low to high and the lights remain illuminated. However, Q1 remains high only for the duration of the time period defined by the RC time constant. At the expiration of this time period, Q1 goes from high to low (shown at approximately time t5.5), which causes the output of XOR 339 to go low, thereby causing transistor 341 to stop conducting. This shuts off the LEDs 31.

In accordance with the above discussion, the operation of the switch 40 causes the LEDs 31 to illuminate when an individual raises a foot from contact with the ground. The LEDs 31 will illuminate for the time period defined by the RC time constant or until the individual's foot again contacts the ground, whichever occurs first. The RC time period, after which the circuit automatically extinguishes the LEDs, can be adjusted by altering the values of capacitor 333 and resistor 334.

The circuit of FIG. 6 can be realized using relatively few components. In addition to the Motorola multivibrator chip discussed above, Motorola integrated circuit number 14070 provides an exclusive OR circuit on a chip, or if enough units were to be manufactured, the multivibrators, exclusive OR circuit and transistor 341 could be provided on a single, application specific integrated circuit ("ASIC"). This would increase the reliability of the present invention by eliminating the need for making multiple connections between a plurality of integrated circuit chips and RC components. It would also reduce the cost of the present invention by cutting down assembly time and easing the manufacturing process.

The circuit of FIG. 6 has been described using a normally closed pressure switch as the switch 40. The advantage to such a switch is that leakage current, i.e., the slow drain of current to ground resulting in a power drain is reduced to zero when the wearer is applying pressure thereto. This is due to the open circuit condition caused when switch 40 is open. However, leakage current is not excessive when a 50 kΩ pull-up resistor 330 is used. Thus, it is possible to substitute a standard, normally open membrane switch for the normally closed pressure switch.

In addition, the Motorola integrated circuits used with the described embodiment are preferably made with a complimentary metal oxide semiconductor (or "CMOS") architecture. CMOS circuitry is used in the preferred embodiment due to its low power consumption. CMOS circuits typically draw power only when a transition occurs (i.e., a change in the circuit from a quiescent state). Thus, in addition to the benefits derived from using a normally closed switch in the preferred embodiment, the use of CMOS technology also will enhance the ability of the present invention to consume as little power as possible.

To use a normally open membrane switch as the switch 40 several adjustments to the circuit 33 would be required, primarily with respect to the inputs of the OR gates 331 and 332. OR gate 331 would have a first, non-inverted input tied to the point between switches 343 and 40. A second, inverted input of OR gate 331 would be tied to the +3 v power supply. OR gate 332 would have a first, non-inverted input tied to "ground." A second, inverted input of OR gate 332 would be tied to the point between switches 343 and 40.

By adjusting the connections of OR gates 335 and 336, the operation of the circuit 33 when using the normally open switch is the same with respect to the lighting of the LEDs 31 as with the above-discussed normally closed switch 40. When a wearer lifts a foot from the ground, the LEDs light. When the foot is returned to the ground, the LEDs are turned off.

Of course, one skilled in the art would readily appreciate that numerous other modifications and/or additions can be made to the above-discussed features of the present invention without departing from the spirit and scope of the present invention. It is intended that the present invention encompass all such modifications.

What is claimed is:

1. Footwear for improving visibility of a wearer thereof, said footwear including an upper portion contacting an upper surface of a wearer's foot and a sole portion that underlies a lower surface of the wearer's foot and supports the wearer's foot against the ground, the improvement comprising:

a light source mounted in said footwear such that light emitted from said light source is visible exteriorly of said footwear;

a power source disposed in said footwear for energizing said light source;

first switch means, disposed in said footwear and operatively responsive to pressure from the weight of the wearer so as to close when the wearer's foot is removed from the ground and pressure on said first switch means is released, for initiating illumination of said light source; and processing means, disposed in said footwear and operatively responsive to said first switch means, for supplying power to said light source when the wearer's foot is removed from the ground and for removing power from said light source when at least one of the wearer's foot is returned to the ground and a predetermined period of time has elapsed.

2. The footwear of claim 1, wherein said processing means includes timing means, operatively responsive to said first switch means, for removing power from said light source after said predetermined period of time has elapsed.

3. The footwear of claim 2, wherein said first switch means includes:

an on-off switch that is in a normally closed condition, said switch having an actuator for opening said switch in response to a force exerted on said actuator and being disposed in said sole portion between the wearer's foot and the ground such that, when the wearer's weight is applied to the ground through the agency of said sole portion, a force is exerted on said actuator, thereby opening said switch, and when the wearer's weight is removed from the ground the force exerted on said actuator is removed, thereby returning said switch to said normally closed condition.

4. The footwear of claim 1, wherein said light source comprises a light emitting diode.

5. The footwear of claim 1, further comprising:

second switch means disposed in said footwear, for deactivating said light source.

6. The footwear of claim 5, wherein said second switch means is operatively connected with said processing means, said processing means being disabled in response to an operation of said second switch means.

7. The footwear of claim 1, wherein said processing means comprises:

first means, responsive to a first operation of said first switch means, for generating a first output signal in accordance with said first operation of said first switch means;

second means, responsive to a second operation of said first switch means, for generating a second output signal in accordance with a second operation of said first switch means;

circuit means, responsive to said first output signal for generating a start signal, and responsive to said second output signal for terminating said start signal; and second switch means, responsive to said start signal for causing illumination of said light source.

8. The footwear of claim 7, wherein said timing means includes:

means, operatively connected with at least one of said first and second means, for enabling said at least one of said first and second means to generate one of said first and second output signals, respectively, for a predetermined period of time; and means for preventing at least one of said first and second means from generating one of said first and second output signals, respectively, after said predetermined period of time has elapsed.

9. Footwear for improving visibility of a wearer thereof, said footwear including an upper portion contacting an upper surface of a wearer's foot and a sole portion that underlies a lower surface of the wearer's foot and supports the wearer's foot against the ground, the improvement comprising:

a light source mounted in-said footwear such that light emitted from said source is visible exteriorly of said footwear;

a power source disposed in said footwear for energizing said light source;

first switch means, disposed in said footwear and operatively responsive to close when the wearer's foot is removed from the ground, for initiating illumination of said light source; and processing means, disposed in said footwear and operatively responsive to said switch means, for supplying power to said light source when the wearer's foot is removed from the ground and for removing power from said light source when at least one of the wearer's foot is returned to the ground and a predetermined period of time has elapsed, wherein said processing means comprises:

a first OR gate having a first input connected with said first switch means, a second input connected with an electrical ground, and an output;

a first multivibrator having an input connected with said output of said first OR gate, and an output;

a second OR gate having a first input connected with said first switch means, a second input connected with said power supply, and an output;

a second multivibrator having an input connected with said output of said second OR gate, and an output;

an exclusive OR circuit having first and second inputs connected with said outputs of said first and second multivibrators, respectively; and a transistor having a base connected to said exclusive OR circuit, an emitter connected with an electrical ground, and a collector connected to a first end of said light source, said light source being connected at a second end thereof with said power source, wherein said first multivibrator responds to a first operation of said first switch means to produce a first output signal, said exclusive OR circuit being responsive to said first output signal to provide a driving signal to said base, said transistor being enabled in response to said driving signal to conduct current, thereby causing said light source to illuminate.

10. The footwear of claim 9, wherein said second multivibrator responds to a second operation of said first switch means to produce a second output signal, said exclusive OR circuit stopping the provision of said driving signal in response to said second output signal, wherein said transistor is disabled in response to the stopping of said drive signal, thereby causing said light source to stop illumination thereof.

11. The footwear of claim 9, further including a timing circuit, operatively connected with said first multivibrator and responsive to operation of said first switch means, for producing a timing signal for a predetermined period of time, said timing signal ceasing after said predetermined period of time has elapsed, wherein said first multivibrator ceases to produce said first output signal in response to the ceasing of said timing signal.

12. The footwear of claim 11, wherein said exclusive OR circuit stops providing said drive signal in response to the ceasing of said first output signal after said predetermined period of time has elapsed, wherein said transistor is disabled in response to the stopping of said drive signal, thereby causing said light source to stop illuminating.

13. The footwear of claim 10, wherein said second multivibrator includes an inverted reset input, coupled with said output of said first multivibrator, for resetting said second multivibrator when said first output signal is equal to a logical 0.

* * * * *